United States Patent [19]

Jernberg et al.

[11] Patent Number: 4,846,415

[45] Date of Patent: Jul. 11, 1989

[54] ROLL HOLDER

[75] Inventors: Marita Jernberg; Mikael Käll, both of Mariestad, Sweden

[73] Assignee: Holmens Bruk Aktiebolag, Norrkoping, Sweden

[21] Appl. No.: 180,384

[22] Filed: Apr. 12, 1988

[30] Foreign Application Priority Data

Apr. 16, 1987 [SE] Sweden ..... 8701633

[51] Int. Cl.[4] ..... B65H 19/00

[52] U.S. Cl. ..... 242/55.53; 225/46; 225/51; 225/82; 225/106

[58] Field of Search ..... 242/55.2, 55.53, 75.2; 312/37-39; 225/39, 46, 47, 51, 52, 77, 82, 106

[56] References Cited

U.S. PATENT DOCUMENTS

| | | | |
|---|---|---|---|
| 1,987,154 | 1/1935 | Noffsinger | 242/55.2 |
| 2,742,241 | 4/1956 | Miller | 242/55.53 |
| 2,805,112 | 9/1957 | Krueger | 242/55.53 X |
| 3,040,943 | 6/1962 | Bump | 225/52 |
| 3,409,340 | 11/1968 | Clark | 242/55.3 |
| 3,729,145 | 4/1973 | Koo et al. | 242/55.53 |
| 4,180,160 | 12/1979 | Ogawa et al. | 225/106 X |
| 4,614,312 | 9/1986 | Del Pino | 242/55.3 |

FOREIGN PATENT DOCUMENTS

| | | | |
|---|---|---|---|
| 0107487 | 5/1984 | European Pat. Off. . | |
| 42700 | 4/1916 | Sweden . | |
| B8405108 | 5/1986 | Sweden . | |
| 2095212 | 9/1982 | United Kingdom | 225/46 |

*Primary Examiner*—David Werner

*Attorney, Agent, or Firm*—Frishauf, Holtz, Goodman & Woodward

[57] ABSTRACT

A holder, e.g., for rolls of paper is configured such as to dispense a paper web from the holder via a web braking element (14, 15, 17), which may have alternative forms. The web braking (14, 15, 17) prevents paper from being dispensed uncontrollably from the holder as a result of inertia forces or some other circumstance. The holder is comprised preferably of two major parts, namely a back plate (1) and a causing (2), which houses the roll (4) and roll support means (8, 9). When the roll (4) is placed horizontally in the casing the roll is supported on two shafts (8). When the roll extends vertically in the casing, it is supported by a shelf (9). The shelf has formed therein an aperture (10) through which the paper web passes.

15 Claims, 2 Drawing Sheets

ROLL HOLDER

BACKGROUND OF THE INVENTION

The present invention relates to a versatile storage device and holder for web material in roll form, from which the web material can be taken alternatively from the outer periphery of the roll or from a central cavity therein.

Many kinds of materials intended for many different uses are sold in roll form. Kitchen paper and toilet paper are each examples of material in roll form used on a daily basis. Gasoline stations, workshops and other places of work are normally equipped with holders which carry paper or some equivalent material for cleaning or drying the hands, wiping clean filler-cap openings or other dirty surfaces. Public toilets and similar buildings are also often equipped with paper towels in roll form.

When the web of material is paper, the web can be torn with relative ease, and the ease with which such webs can be torn is normally enhanced by the presence of perforations. In the case of webs of woven or non-woven fabrics, fiber cloth, it is necessary to provide the web with tear lines or weakenings along which the web can be torn, so that the web can be separated into pieces that are of a size suitable for the purpose intended.

When material is taken from a roll through the central cavity thereof, the material, at some stage in the life of the roll, will continue to unroll freely, in the absence of a pulling force, subsequent to withdrawing a piece of the material from the roll center. This is, of course, due to gravity, a fact which is of small comfort when a roll unwinds in this way, to leave the material in a heap on the floor.

An attempt has been made to overcome this problem with the aid of the invention disclosed in SE 8405108-5. The dispensing arrangement described in this publication is intended solely for unwinding a paper web axially from the center cavity of a roll.

In SE-B-8405108-5, the device which prevents the paper web from falling gravitationally from the roll has the form of an angled spring-loaded arm.

With regard to roll holders which are intended for supporting rolls from which material is unwound from the outer periphery of the roll, it will be observed that the radius of the roll constitutes a lever arm which, multiplied by the weight of the downwardly hanging material web, constitutes a turning moment which is counteracted by the friction engendered between the roll bobbin and its journal(s). This is most pronounced when the roll is full and thus presents the longest lever arm. When a piece of the web is drawn from the roll, the roll will rotate and generate inertia forces which can cause the roll to unwind. This problem is accentuated in the case of heavy rolls of relatively large diameter, such as paper rolls in public toilets and paper towel rolls in work shops for instance.

A further problem occurring with spindle-carried or bobbin carried rolls with which material is taken from the outside of the roll is that the friction in the bobbin bearing must not be so great as to cause the material web to be torn-off at inappropriate locations therealong when pulling off the web, i.e. so that excessively short lengths are obtained. This problem is particularly pronounced when the material web is perforated. If, on the other hand, the friction is too small, there is insufficient braking force to counteract the inertia forces generated by the roll as it is rotated by pulling off material from the outer roll periphery. Even when a desired length of web is torn off quickly, so that no material is left hanging from the roll to cause the aforesaid automatic unwinding of the roll, the inertia forces generated by rotation of the roll will maintain the roll in motion. The material will thus continue to unwind unhindered from the roll.

OBJECTS OF THE INVENTION

The prime object of the present invention is to provide a holder for material webs in roll form which includes means for preventing the material from being unwound gravitationally or as a result of the force of inertia of the roll in rotation. A further object is to provide a roll holder intended for carrying a roll with which material is taken from the outer periphery of the roll which minimizes the risk of severing the web upon acceleration of the roll. Still another object is to provide a holder which will support the roll vertically or horizontally for internal or external unwinding of the roll material. A further object is to provide a holder into which a fresh roll can be fitted easily.

SUMMARY OF THE INVENTION

According to the present invention, a holder for carrying a thin web material in roll form comprises a casing including a back plate having means for securing the casing to a supporting surface; and a cover member coupled to the back plate first roll support means for supporting a roll in the casing of the holder with the roll oriented in a horizontal direction; and second roll support means including shelf means having an aperture therein and which extends from the back plate of the casing at an angle to the back plate for supporting a roll on the shelf means with the roll oriented in a vertical direction such that the material web may be taken out from a central cavity of the vertically arranged roll and through the shelf aperture. Further provided are web braking elements located downstream of the first and second roll support means in the direction in which the web is drawn from the roll.

DETAILED DESCRIPTION

Figure 1:
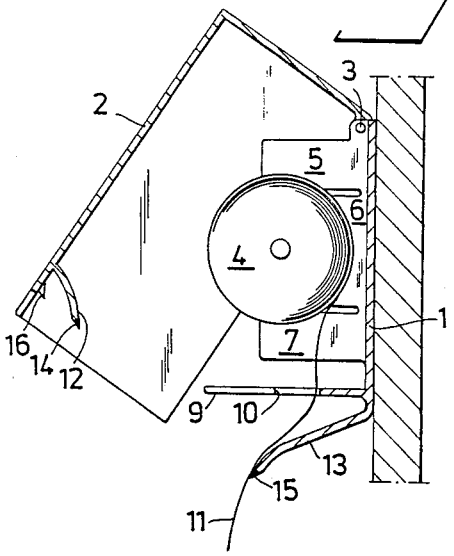
FIG. 1 is a vertical sectional view of a roll holder according to the present invention with the lid of the holder slightly raised and containing a horizontally positioned roll of paper.
Figure 2:
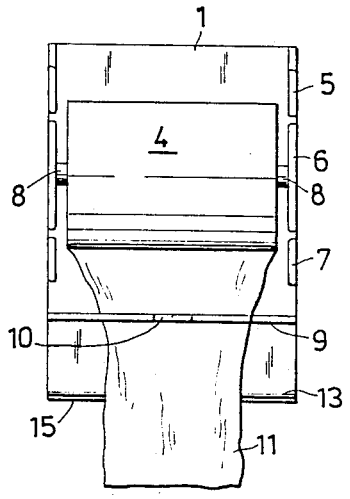
FIG. 2 illustrates the back plate of a roll holder and a horizontally mounted roll of paper.

A roll holder for supporting a roll of relatively thin material comprises a back plate 1 which is intended to be secured to a wall or like support surface. The back plate is provided with a suitable attachment means which enables a casing 2 to be connected to the back plate, said casing comprising a front wall, two side walls and a lid and being essentially open at the bottom. The attachment means preferably comprises elements which co-act with a hinge 3 such as to allow the casing 2 to be raised through 90° when inserting a paper roll 4, thereby facilitating loading of the holder.

The two vertical side edges of the back plate 1 each have extending therealong side-wall sections 5, 6, 7 which protrude outwardly at an angle to the plane of the back plate. The upper and lower pairs of sections 5 and 7 are intended to hold the roll in position laterally and act as casing guides when lowering the casing 2 subsequent to loading the holder. The side-wall sections 5, 7 may also be configured for co-action with means provided on the inside of the casing 2 in a manner to obtain a snap-lock arrangement.

Figure 3:
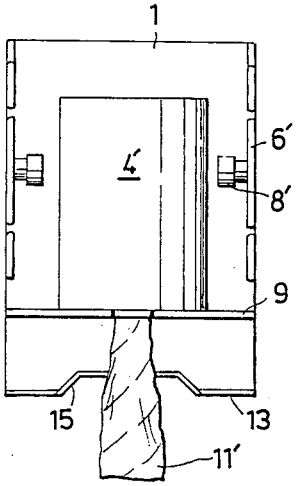
FIG. 3 illustrates the back plate of a holder and a vertically mounted roll of paper.

The intermediate side-wall sections 6 carry roll-support shafts 8, which are intended to be inserted into the central cavity or cylindrical hole of the paper roll, so as to support the roll horizontally. The shafts 8 are preferably made of a thermoplastic material which presents only a small frictional force against the sleeve of the paper roll, and, as seen in FIG. 3, the length of respective shafts 8 is such as to enable a roll to be placed horizontally on the mutually opposing shafts when bending laterally outwards the side-wall sections 6, which are made of a flexible, resilient material, whereafter the shafts 8 are allowed to spring back, into the central cavity of the roll 4. Alternatively, the roll-support shafts 8 may have a telescopic construction which includes a spring. This enables the back plate 1 and its side-wall sections to be made of a rigid material. Subsequent to loading a paper roll into the holder, the casing 2 can be lowered, so that its front wall extends vertically. Prior to lowering the casing, however, sufficient paper should be drawn from the roll, to ensure that a length of paper will hang from the holder when the casing is lowered. This length of paper is passed through a T-shaped aperture 10 in a shelf 9. The shelf 9 is preferably formed integrally with the back plate 1 of the holder and extends perpendicularly to the plane of said plate. The aperture 10 in the shelf 9 extends to the forward edge of the shelf. This enables a length 11 of the paper roll 8 to be passed in through the part of the aperture forming the stem of the T and then flattened out to practically its full width in the horizontal component of the T-shaped aperture.

The front wall of the casing 2 has firmly mounted on the inner surface thereof a first lip 12 which when the casing 2 is in its lower position terminates at a short distance from a second lip 13 which extends forwardly from the back plate 1 of the holder and beneath the shelf 9. The lips 12, 13 may be provided with tip or edge elements of alternative configuration. In their simplest form the tip or edge elements may consist of rubber strips 14, 15.

The purpose of the rubber strips 14, 15 is to brake the paper web as it moves between the lips 12, 13. This function of the strips has its greatest significance in the aforesaid case of a relatively heavy paper roll being set in motion by pulling the paper web from the roll or holder. The effect of the resultant inertia forces causes the roll to continue to rotate even when the pulling force on the paper web ceases. This results in more paper being unwound from the roll. When the pulling force on the paper web ceases and paper is no longer pulled from the holder, paper which unwinds as a result of free-rotation of the roll will collect in folds on the shelf 9, until the roll comes to a stop. When paper is again taken from the holder, by pulling on the length of paper web hanging beneath the holder, the paper laid in folds on the shelf 9 will be taken first, through the aperture 10, and the roll 4 will not begin to rotate until the paper on the shelf 9 has been withdrawn from the holder.

As shown in FIG. 3, when a roll 4' is placed vertically in the holder, so that the paper web can be withdrawn from the centre of the roll 4', the roll is supported by the shelf 9. When loading the holder with a paper roll, the outgoing length 11' of the paper web is first passed out through the stem part of the T-shaped aperture 10. This paper length 11' is then fitted between the lips 12, 13. When this method of use is applied, the edges of the paper web will be supported by the shelf 9, quite soon after the inner turns of the roll have been used, with the exception of the region of the three gaps where the paper web crosses the T-shaped opening 10.

The roll holder is advantageously provided with a tear edge 16 by means of which desired lengths of paper can be torn off, irrespective of whether the paper web is perforated or not. The tear edge 16 is preferably placed in a safe position on the inner surface of the casing front wall, so that there is no danger of inadvertent contact with the fingers or hand, and to that it is ensured that a readily grippable length of paper 11 will hang beneath the lips 12, 13 after tearing off paper from the roll.

As beforementioned, the braking elements on the lips 12, 13 may comprise other devices than the rubber strips 14, 15. For example, when the main parts of the roll holder, i.e. the back plate 1 and the casing 2, are made of a thermoplastic material, the edges of the lips may be thinned down, so that these edges become resilient or springy and therewith afford the desired braking effect.

Figure 5:
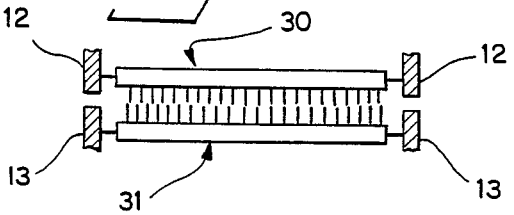
FIGS. 5 and 6 are illustrations of modified web braking elements.

Alternatively, as shown in FIG. 5, the web braking elements may have the form of elongated brushes 30, 31 attached to respective lips 12, 13.

In accordance with one variant of the invention, the lips 12, 13 are spaced apart to an extent which enables a hand to be inserted therebetween. Extending parallel with the tips or edges of the lips are two rows of resiliently mounted diameter than the others. This variant enables a hand to be inserted readily into the holder for the purpose of re-feeding the paper web out of the holder, in the event of the paper web separating inside the holder. This variant is suitable when the casing 2 is capable of being locked.

Figure 6:
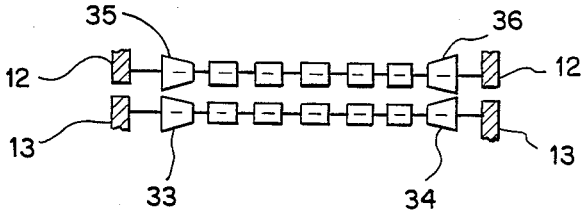

In accordance with a further alternative, shown in FIG. 6, the web braking elements on the tips or edges of the lips may comprise two rows of rollers. These rollers may also be resiliently sprung. The rollers 33–36 located nearest the edge of the paper web are preferably conical, with their respective bases facing outwards, as seen in FIG. 6. In this case the greatest braking effect is obtained at the edge of the paper web and perforated paper is torn from the edge and inwards. One advantage with this variant is that a readily grippable length of the paper web will always protrude beneath the rollers at the location of the smallest diameter rollers.

Figure 4:
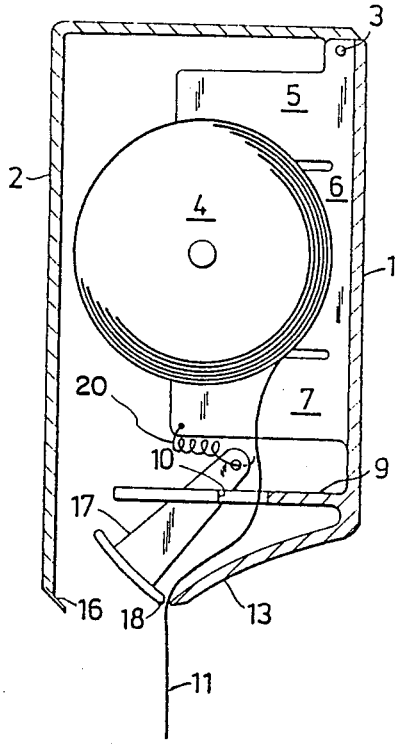
FIG. 4 is a vertical sectional view of a holder provided with an alternative outlet.

In accordance with another variant of the roll holder, as seen in FIG. 4, the forwardly located lip 12 is replaced with an element 17 in the form of a suspended cradle 17 having a center of gravity located eccentrically with respect to the axis of suspension thereof. Alternatively, the element 17 may be arranged to co-act, under the force of a spring 20, with the lip 13 extending from the back plate 1 in a manner such that when the element 17 is at rest the edge 18 thereof located nearest the back plate 1 will abut the tip or edge of the lip 13. In yet another variant (not shown) the lip 13 is replaced with an element 17 which is spring biassed against the lip 12. The cradle-like element 17 may be journalled in the side walls of the casing 2 in a manner which will enable the element to be moved to one side when needing to draw the end of the paper web out through the aperture 10.

The various web braking elements, including foamed plastic or foam rubber strips, may be configured so that the greatest braking effect occurs at the edges of the material web. This will cause perforated material webs to separate from the edges as the web is drawn out, before the web is separated across the whole of its width. This will ensure that a wedge or slip of paper is always accessible for subsequent withdrawal of material from the roll.

We claim:

1. A holder for carrying a thin web material in roll form, comprising:

a casing including a back plate (1) having means for securing the casing to a supporting surface; and a cover member (2) coupled to said back plate (1);

first roll support means (8) for supporting a roll (4) in said casing of the holder with the roll oriented in a horizontal direction;

second roll support means including shelf means (9) having an aperture (10) therein and which extends from said back plate (1) of said casing at an angle to said back plate (1) for supporting a roll (4') on said shelf means with the roll (4') oriented in a vertical direction such that the material web (11') may be taken out from a central cavity of the vertically arranged roll (4') and through said shelf aperture (10); and web braking elements (14, 15; 17) located downstream of said first and second roll support means (8, 9) in the direction in which the web is drawn from the roll.

2. The holder of claim 1, wherein said first roll support means comprises roll support shafts (8) mounted for engagement with a center cavity of the roll (4) for supporting the roll horizontally and to permit unwinding of web material from the outer periphery of said horizontally supported roll.

3. The holder of claim 2, wherein:

said casing comprises a pair of spaced apart resilient side-wall sections (6) projecting forwarding from said back plate (1);

said first roll support means comprises a pair of roll support shafts (8) attached to and extending form a respective one of said resilient side-wall sections; and said support shafts (8) being insertable in a central cavity of said roll and being made of a material which exerts only a small frictional force on the material defining the central cavity of the roll (4).

4. The holder of claim 1, wherein said shelf aperture (10) has a substantially T-shape having a leg portion which extends to and opens at a forward edge of said shelf means (9) to facilitate insertion of the web material into said shelf aperture (10).

5. The holder of claim 1 or 4, wherein said web braking elements (14, 15; 17) are located beneath said shelf means (9) for engaging the web material drawn from the roll such that excess web material unwound from a roll supported horizontally on the first roll support means (8) collects on said shelf means (9).

6. The holder of any one of claims 1–4, wherein said web braking elements comprise two mutually co-acting lip edge means (14, 15) which are formed of an elastic material and each of which is attached to a respective part of said casing for engaging web material fed therebetween.

7. The holder of any one of claim 1–4, wherein said web braking elements comprises a pair of mutually opposing brushes each of which is attached to a respective part of said casing for engaging web material fed therebetween.

8. The holder of any one of claims 1–4, wherein said web braking elements comprise two rows of rollers, of which the outermost roller in each row widens outwardly of the rows of rollers.

9. The holder of any one of claim 1–4, wherein one of said web braking elements is fixed, and wherein the other of said web braking elements is movably mounted relative to the fixed web braking element.

10. The holder of claim 9, further comprising biasing means for biasing said movable web braking element toward said fixed web braking element.

11. The holder of claim 9, wherein said movable web braking element comprises a pivotally mounted cradle (17) which extends transversely to the path of the material web (11) and the center of gravity of which is located eccentrically with respect to the axis of suspension thereof, such that said movable web braking element is self biased toward said fixed web braking element.

12. The holder of claim 11, further comprising biasing means for biasing said movable web braking element toward said fixed web braking element.

13. The holder of claim 9, wherein said fixed web braking element (13) extends from said back plate (1), and said movable web braking element (18) is pivotally mounted to said shelf means (9).

14. The holder of claim 13, further comprising biasing means for biasing said movable web braking element toward said fixed web braking element.

15. The holder of claim 1, further comprising tear edge means (16) located in said holder casing between said web braking elements and a material web outlet.

* * * * *